United States Patent [19]

Ferguson

[11] Patent Number: 4,744,777

[45] Date of Patent: May 17, 1988

[54] POWER STEERING SYSTEM FOR MARINE PROPULSION DEVICE

[75] Inventor: Arthur R. Ferguson, Northbrook, Ill.

[73] Assignee: Outboard Marine Corporation, Waukegan, Ill.

[21] Appl. No.: 28,958

[22] Filed: Mar. 23, 1987

[51] Int. Cl.[4] ..... B63H 25/02

[52] U.S. Cl. ..... 440/61; 440/63; 180/163

[58] Field of Search ..... 91/216 R, 444; 180/158, 180/159, 162, 163, 79, 132, 154; 440/53, 49, 61, 63; 144/144 R, 144 A, 154, 157, 150; 74/388 R, 388 PS, 480 B, 484 R, 486, DIG. 8

[56] References Cited

U.S. PATENT DOCUMENTS

| | | | |
|---|---|---|---|
| 2,928,377 | 4/1955 | Ford | 114/150 |
| 2,929,362 | 8/1954 | Hayner | 121/41 |
| 3,373,642 | 2/1966 | Simpson | 83/76 |
| 3,590,690 | 7/1971 | Dalbera | 244/226 |
| 3,631,833 | 1/1969 | Shimanckas | 115/18 |
| 4,227,481 | 10/1980 | Cox | 440/61 |
| 4,295,833 | 10/1981 | Borst | 440/63 |
| 4,373,920 | 2/1983 | Hall | 440/59 |
| 4,419,084 | 12/1983 | Borst | 440/58 |
| 4,449,945 | 5/1984 | Ferguson | 440/53 |
| 4,568,292 | 2/1986 | Hall | 440/61 |
| 4,595,370 | 6/1986 | Small | 440/53 |
| 4,615,290 | 10/1986 | Hall | 114/150 |

*Primary Examiner*—Joseph F. Peters, Jr.
*Assistant Examiner*—Clifford T. Bartz
*Attorney, Agent, or Firm*—Michael, Best & Friedrich

[57] ABSTRACT

Disclosed herein is a power steering system for a marine propulsion device having a propulsion unit movable around a generally vertical steering axis, the power steering system comprising a tilt tube for affording tilting movement of the propulsion unit around a tilt axis substantially transverse to the steering axis, a steering ram within the tilt tube for bi-directional movement relative to the tilt tube and having a projecting end, a power steering cylinder fixed relative to the tilt tube, a piston reciprocable within the power steering cylinder, a piston rod having an inner end connected to the piston and having an outer end extending from the steering cylinder, a spool valve assembly including a first member mounted to the outer end of the piston rod, and a second member reciprocably moveable relative to the first member, an elongate bell crank having a first end pivotally connected to the projecting end of the steering ram, having a second end pivotally connected to the second member and being pivotally connected between the first and second ends to the first member for movement relative to the first member, and linkage means coupled between the outer end of the piston rod and the propulsion unit for pivoting the propulsion unit around the steering axis in response to movement of the piston rod relative to the cylinder.

21 Claims, 1 Drawing Sheet

POWER STEERING SYSTEM FOR MARINE PROPULSION DEVICE

RELATED APPLICATIONS

Reference is made to the co-pending application of Arthur R. Ferguson, Ser. No. 614,821, entitled Marine Propulsion Device Power Steering System, filed May 29, 1984, now U.S. Pat. No. 4,710,141, issued 12/1/87 and assigned to the assignee hereof.

Reference is also made to the co-pending application of Arthur R. Ferguson, Ser. No. 710,494, entitled Marine Propulsion Device Power Steering System, filed Mar. 11, 1985, now abandoned and assigned to the assignee hereof.

BACKGROUND OF THE INVENTION

This invention relates generally to marine propulsion devices, such as outboard motors and stern drive units, and particularly to power steering system for use with such marine propulsion devices.

Attention is directed to the following U.S. Pat. Nos.:

| | | |
|---|---|---|
| Hall | 4,615,290 | October 7, 1986 |
| Small | 4,595,370 | June 17, 1986 |
| Hall | 4,568,292 | February 4, 1986 |
| Ferguson | 4,449,945 | May 22, 1984 |
| Hall et al. | 4,373,920 | February 15, 1983 |
| Borst | 4,295,833 | October 20, 1981 |
| Cox et al. | 4,227,481 | October 14, 1980 |
| Shimanckas | 3,631,833 | January 4, 1972 |
| Simpson | 3,373,642 | March 19, 1968 |
| Hayner | 2,929,362 | March 22, 1960 |
| Ford | 2,928,377 | March 15, 1960 |

SUMMARY OF THE INVENTION

The invention provides a marine propulsion device comprising a propulsion unit including a propeller adapted to be driven by a suitable power source, mounting means adapted to be mounted on a boat for supporting the propulsion unit for pivotal steering movement around a generally vertical steering axis and including a tilt tube for affording tilting movement of said propulsion unit around a tilt axis substantially transverse to the steering axis, a steering ram within the tilt tube for bi-directional movement relative to the tilt tube and having a projecting end, a power steering cylinder fixed relative to the tilt tube, a piston reciprocable within the power steering cylinder, a piston rod having an inner end connected to the piston and having an outer end extending from the steering cylinder, a spool valve assembly including a first member mounted to the outer end of the piston rod and a second member reciprocably moveable relative to the first member, an elongate bell crank having a first end pivotally connected to the projecting end of the steering ram and having a second end pivotally connected to the second member and being pivotally connected between the first and second ends to the first member for movement relative to the first member, and linkage means coupled between the outer end of the piston rod and the Propulsion unit for pivoting the propulsion unit around the steering axis in response to movement of the piston rod relative to the cylinder.

In one embodiment, the steering cylinder is substantially parallel to the tilt tube and the reciprocative movement of the second member relative to the first member is in a direction substantially parallel to the tilt tube.

In one embodiment, the bell crank is oriented substantially perpendicularly to the steering ram such that movement of the steering ram in one direction results in movement of the second member relative to the first member in a direction substantially opposite the direction of movement of the steering ram.

In one embodiment, the marine propulsion device further comprises a source of pressurized hydraulic fluid and the spool valve assembly, in response to movement of the second member relative to the first member, controls passage of the hydraulic fluid to the steering cylinder to move the piston rod such that the piston rod substantially follows the steering ram in response to movement of the steering ram relative to the tilt tube.

In one embodiment, the first member comprises a spool valve housing and the second member comprises a spool valve.

In one embodiment, the propulsion unit includes a steering arm extending substantially radially relative to the steering axis and the linkage means includes a steering link connected between the outer end of the cylinder rod and the steering arm.

The invention also provides a power steering system for a marine propulsion device including a propulsion unit and a mounting assembly for supporting the propulsion unit for pivotal steering movement around a generally vertical steering axis, the power steering system comprising a tilt tube for affording tilting movement of the propulsion unit around a tilt axis substantially transverse to the steering axis, a steering ram within the tilt tube for bi-directional movement relative to the tilt tube and having a projecting end, a power steering cylinder fixed relative to the tilt tube, a piston reciprocable within the power steering cylinder, a piston rod having an inner end connected to the piston and having an outer end extending from the steering cylinder, a spool valve assembly incuding a first member mounted to the outer end of the piston rod, and a second member reciprocably moveable relative to the first member, an elongate bell crank having a first end pivotally connected to the projecting end of the steering ram, having a second end pivotally connected to the second member and being pivotally connected between the first and second ends to the first member for movement relative to the first member, and linkage means coupled between the outer end of the piston rod and the propulsion unit for pivoting the propulsion unit around the steering axis in response to movement of the piston rod relative to the cylinder.

In one embodiment, the spool valve assembly is oriented such that the first direction is substantially parallel to the steering ram so that movement of the steering ram in one direction results in movement of the second member relative to the first member in substantially the opposite direction.

In one embodiment, the first direction is substantially toward the first chamber such that the piston moves to drive the piston rod so as to substantially follow movement of the steering ram.

In one embodiment, the power steering system further comprises linkage means coupled to the steering rod and the propulsion unit for pivoting the propulsion unit around the steering axis in response to movement of the piston rod relative to the power steering cylinder.

In one embodiment, the bell crank comprises an elogate member and the pivotal connections to the bell crank are substantially co-linearly aligned.

Various other principal features of the invention will become apparent to those skilled in the art upon review of the following detailed description, claims, and drawings.

Figure 1:
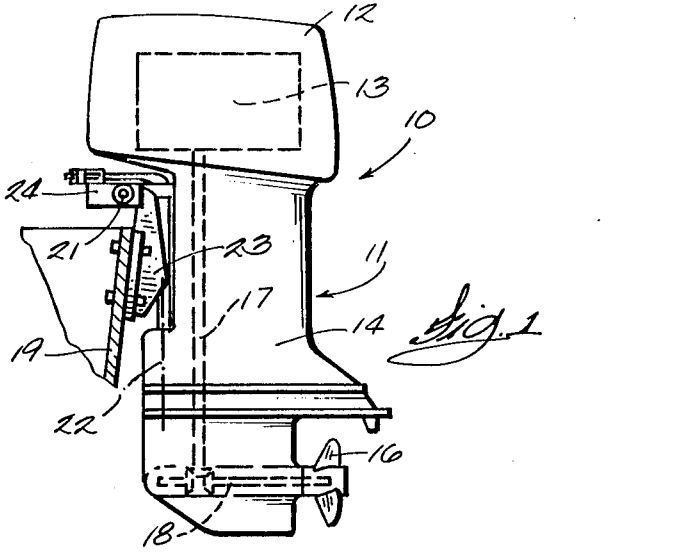
FIG. 1 is a side elevational view of a marine propulsion device which includes a power steering system and which embodies the invention.

Before one embodiment of the invention is explained in detail, it is to be understood that the invention is not limited in its application to the details of construction and the arrangement of components set forth in the following description or illustrated in the drawings. The invention is capable of other embodiments and of being practiced or carried out in various ways. Also, it is to be understood that the phraseology and terminology used herein is for the purpose of description and should not be regarded as limiting.

DESCRIPTION OF THE PREFERRED EMBODIMENT

Illustrated in the drawings is a marine propulsion device 10, such as an outboard motor or stern drive unit, incorporating various of the features of the invention. In the specific construction illustrated, the marine propulsion device 10 is in the form of an outboard motor and includes a propulsion unit 11, having an upper power head 12 housing an internal combustion engine 13, and a lower unit 14 carrying a rotatably mounted propeller 16 connected to the engine 13 via a drive shaft 17 and a propeller shaft 18.

The marine propulsion device 10 further includes means for mounting the propulsion unit 11 on a boat transom 19 for vertical tilting movement about a generally horizontal or tilt axis 21 and for pivotal movement in opposite directions about a generally vertical or steering axis 22 transverse to the tilt axis 21. While various suitable mounting means can be used, in the specific construction illustrated, such means includes a mounting assembly comprising a support or transom bracket 23 mounted on the boat transom 19 and a steering cable or swivel bracket 24 pivotally connected to the transom bracket 23 via a horizontally extending steering cable or tilt tube 26. More specifically, the transom bracket 23 has a pair of laterally spaced arms 27 and 28 each including a bore 29 for pivotally receiving the tilt tube 26.

The swivel bracket 24 has a pair of lugs 31 and 32 located adjacent the transom bracket arms 27 and 28 and including an aperture 33 receiving the tilt tube 26. The swivel bracket 24 tilts or pivots in a generally vertical plane relative to the transom bracket 23 about the tilt tube 26, and the horizontal axis of the tilt tube establishes the tilt axis 21.

The propulsion unit 11 is connected to the swivel bracket 24 by a kingpin 34 which affords pivotal swinging movement of the propulsion unit 11 in a generally horizontal plane relative to the swivel bracket 24. The propulsion unit 11 is pivotable in opposite directions about the kingpin 34, and the generally vertical axis of the kingpin 34 establishes the steering axis 22.

The marine propulsion device further includes means for moving the propulsion unit 12 around the steering axis 22. While various suitable steering means can be used, in the specific construction illustrated, such means includes a tiller or steering arm 36 having a rearward portion affixed to the kingpin 34 and the propulsion unit 11 and a forwardly extending arm portion 37, extending radially outwardly from the kingpin 34, providing a lever arm for pivoting the kingpin 34 and the propulsion unit 11 around the steering axis 22.

The steering means also includes a remotely located steering actuator or device 38 including a housing or frame 39 mounted on the boat hull and a shaft 41 rotatably carried by the frame 39 and supporting a steering wheel 42. The steering device 38 is connected to the arm portion 37 of the steering arm 36 via a steering cable assembly 43 to effect pivotal steering movement of the propulsion unit 11 around the steering axis 22 in response to rotation of the steering wheel 42. In the specific construction illustrated, the steering cable assembly 43 includes an outer cable sheath 44 having one end secured to one end of the tilt tube 26 by a threaded member 46 and further includes an inner flexible member, or push-pull cable 47, which is movable relative to the sheath 44. One end of the push-pull cable 47 is connected to the steering wheel shaft 41 and the other end is connected to an elongate, hollow, steering cable ram 48 received within, and mounted for bi-directional sliding movement relative to, the tilt tube 26. The steering cable ram 48 includes an end 50 projecting beyond the end of the tilt tube 26 opposite the threaded member 46.

To increase the steering force applied to the steering arm 36 by the push-pull cable 47, a power steering system or power assist means 49, operably connecting the steering device 38 to the propulsion unit 11, is provided. In the specific construction illustrated, the power assist means or power steering system 49 is supported on the mounting assembly and includes a hydraulic cylinder-piston assembly 51 and a steering link 52 having one end 53 connected by means of a pivot 54 to the portion 37 of the steering arm 36, and an other end 55 opposite the one end 53.

The hydraulic cylinder-piston assembly 51 includes a cylinder 56 mounted on the mounting assembly by means of an attached cylindrical collar **56*a* encircling the tilt tube 26 between the swivel bracket lugs 31 and 32. When so mounted, the cylinder 56 has a fixed, longitudinal axis 57 located in spaced parallel relationship to the tilt tube 26 and the tilt axis 21. The cylinder 56 further includes a piston 58 mounted inside the cylinder 56 for axial reciprocative movement therein. Piston 58 has a central aperture 59 and divides the cylinder 56 into opposite sides or first and second pressure chambers 61 and 62**.

One end 63 of the cylinder 56 is closed by an end wall 64 including a central aperture 66. A tubular piston rod 67, having an inner end 68, slidably extends through the end wall aperture 66 and is fixably connected, at the inner end 68, to the piston 58. The piston rod 67 also includes an outer end 69 extending outwardly from the cylinder 56. The piston rod 67 includes an outer tubular portion 71 and an inner tubular portion 72 which extends through the piston central aperture 59 and forms a first flow passageway 73 communicating with the first pressure chamber 61. The inner tubular portion 72 is concentric with the outer tubular portion 71 and cooperates with the outer tubular portion 71 to define an annular, second flow passageway 74 which communicates with the second pressure chamber 62 through a plurality of apertures 76 formed in the outer tubular portion 71 near the piston 58.

The piston 58 is operated by pressurized hydraulic fluid continuously supplied by a pump 77 which can be driven directly by the engine 13 or by another power source such as an electric motor (not shown) operated by a battery or a generator driven by the engine 13. The pump 77 is connected to a sump or reservoir 78 by a conduit 79 and to the piston and cylinder assembly 51 by a supply conduit 81. Hydraulic fluid from the cylinder-piston assembly 51 is discharged to the reservoir 78 through a return conduit 82. To avoid the development of excessive hydraulic fluid pressure, a hydraulic fluid pressure relief path is provided from the supply conduit 81 to the return conduit 82 by a means of an additional conduit 83 and a vent or relief valve 84. The return conduit 82 is also connected to the supply conduit 81 via a bypass conduit 86 and a check valve 87.

To control the extension and retraction of the piston rod 67, control means are provided for selectively controlling the flow of hydraulic fluid to and from the first and second pressure chambers 61 and 62. In the specific construction illustrated, such means includes a control or spool valve assembly 88 including a first member or spool or valve housing 89 and a second member or spool valve 91 movable relative to each other. The valve housing 89 has an axially extending, generally cylindrical bore or cavity 92 in which the spool valve 91 is mounted for axial movement between a first, or turn-left position and a second, or turn-right position on the opposite sides of a third, center or no-steering change position best illustrated in FIG. 3. Hydraulic fluid is admitted to the cavity 92 through an inlet port 93 connected in communication with the supply conduit 81 and a central annular groove 94 in the valve housing 89. Hydraulic fluid is discharged from the cavity 92 through annular end grooves 96 and 97 in the valve housing 89 spaced on opposite sides of the central groove 94 and through respective return ports or passages 98 and 99 which merge into a single passage or combined return port 101 connected in communication with the return conduit 82.

The valve housing 89 is fixedly mounted to the outer end 69 of the piston rod 67, and is positioned such that reciprocative movement of the spool valve 91 relative to the valve housing 89 is in a direction substantially parallel to the tilt tube 26. Hydraulic fluid flows from the cavity 92 to the cylinder 56 and from the cylinder 56 to the cavity 92 through intermediate annular grooves 102 and 103 and respective steering passages or ports 104 and 106 in the valve housing 89. The steering port 104 is connected in communication with the first passageway 73 of the piston rod 67 (i.e., the interior of the inner tubular portion 72), and the steering port 106 is connected in communication with the second flow passageway 74 of the piston rod 67 (i.e., the annular passage between the inner and outer tubular portions 72 and 71).

The spool valve 91 includes an enlarged, cylindrical central portion or land 107 and enlarged, cylindrical end portions or lands, 108 and 109, spaced from, and on opposite sides of the central land 107. The lands 107, 108 and 109 are dimensioned to slidably and sealingly engage the interior wall of the cavity 92 during axial movement of the spool valve 91.

The power assist means 49 is arranged such that bidirectional movement of the hollow ram 48 in response to rotation of the steering wheel 42 results in reciprocative movement of the spool valve 91 relative to the valve housing 89. To this end, the power assist means 49 includes an elongate bell crank 111 mounted to the valve housing 89 for movement around a pivot 112 located substantially along the longitudinal axis 57 of the cylinder 56. The bell crank 111 includes a pair of ends 113 and 114 and is pivotally connected to the valve housing 89 substantially midway between the ends 113 and 114. One end 113 of the bell crank 111 is pivotally coupled to the outer end of the ram 48 for movement around a pivot axis 116, while the opposite end 114 of the bell crank 111 is coupled to the spool valve 91 for pivotal movement around a pivot axis 117. Preferably, the bellcrank is oriented substantially perpendicularly to the ram 48 and the pivotal connections 112, 116 and 117 are substantially co-linearly aligned. When so connected, the bell crank 111 functions to drive the spool valve 91 inwardly (to the left in FIGS. 2 and 3) relative to the valve housing 89 in response to outward movement (to the right in FIG. 2) of the ram 48 as shown in phantom. Similarly, movement of the ram 48 in the opposite direction (to the left in FIG. 2) causes the spool valve 91 to be partially withdrawn from the valve housing 89. Thus, movement of the spool valve 91 is substantially opposite movement of the ram 48.

The other end 55 of the steering link is also connected, via the pivot 112, to the valve housing 89. Accordingly, the steering link 52 and the steering arm 36 together form a linkage for rotating the propulsion unit 11 around the steering axis 22 in response to movement of the valve housing 89 as the valve housing moves in accordance with movement of the piston rod 67.

Figure 3:
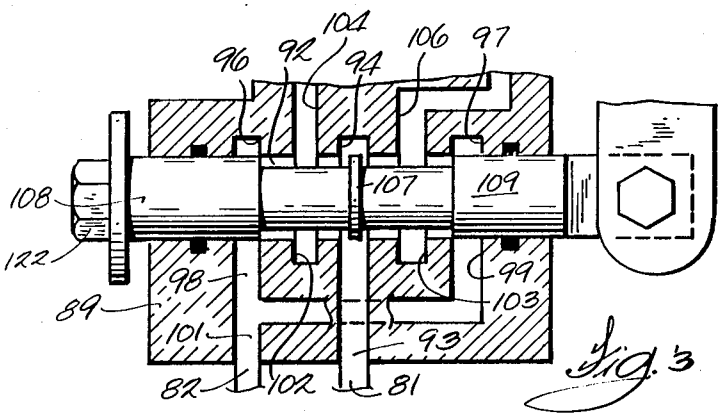
FIG. 3 is an enlarged, fragmentary and schematic view of a control valve used in the power steering system shown in FIG. 2.
Figure 2:
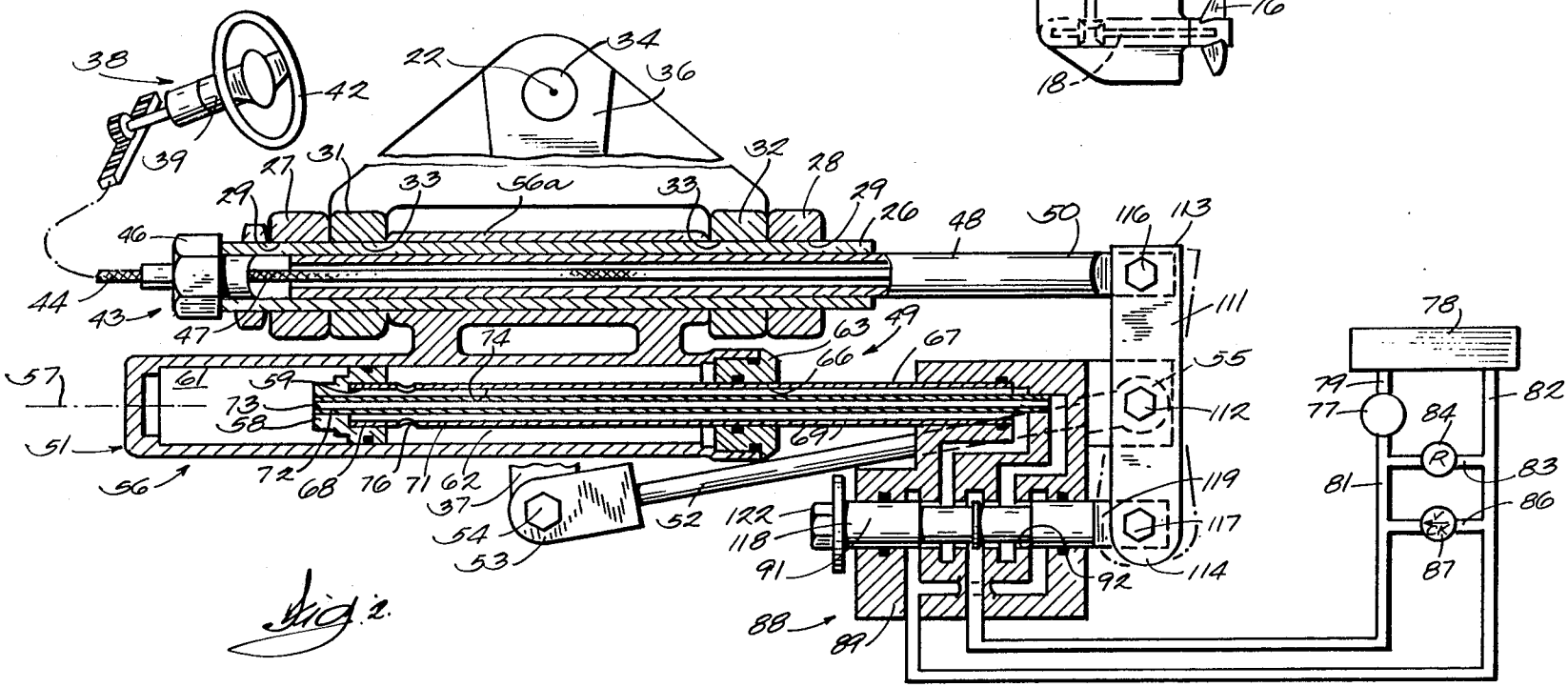
FIG. 2 is an enlarged top view, partially in section, and partially schematic, of the power steering system in the marine propulsion device shown in FIG. 1.

Spool valve 91 has sufficient length to extend fully through the valve housing 89 as best seen in FIGS. 2 and 3. To mechanically connect the push-pull cable 47 with the valve housing 89 in the event hydraulic fluid pressure is lost, shoulder means are provided on spool valve 91 for engaging the opposite ends of the valve housing 89. In the specific construction illustrated, the spool valve 91 includes opposite end portions 118 and 119 projecting outwardly from the opposite ends of the valve housing 89. One end 118 carries a washer 121 which is engageable with the valve housing 89 and which is spaced therefrom a sufficient distance to accommodate axial movement of the spool valve 91 from the illustrated no-steering change position to a turn-right position described in more detail below. The washer 121 is held in place by a nut 122 threaded onto an outermost portion of the spool valve end 118. The other end 119 of the spool valve is connected to one end 114 of the bellcrank which limits the maximum inward movement of the spool valve end 119 relative to the valve housing 89.

In order to reduce the overall width of the power assist means 49 and thereby permit incorporation of the power steering system into a marine propulsion device installation wherein space is limited, the control valve assembly 88, the bell crank 111, the ram 48 and the piston rod 67 are arranged such that the bell crank 111 itself establishes the outermost boundary at one side of the system and such that the ram 48, the piston rod 67 and the valve assembly 88 are all disposed between the bell crank 111 and the steering arm 36.

When the spool valve 118 is in the no-steering change position shown in FIGS. 2 and 3 the central land 107 partially covers or blocks the central groove 94, and the end lands 108 and 109 partially cover or block respective end grooves 96 and 97. Pressurized hydraulic fluid flows into the central groove 94 from the inlet port 93 and past the opposite edges of the central land 107 into the cavity 92. The first pressure chamber 61 is in fluid communication with cavity 92 via the first passageway 73, the steering port 104 and the intermediate groove 102. The second pressure chamber 62 is in fluid communication with cavity 92 via the apertures 76, the second passageway 74, the steering port 106 and the intermediate groove 103. Thus, both sides of the piston 58 are exposed to pressurized fluid when the spool valve 91 is in the no-steering change position.

The pump 77 operates continuously during operation of the propulsion unit 11. Consequently, when the spool valve 91 is in the no-steering change position, a portion of the hydraulic fluid flows from cavity 92 out through the return ports 98, 99 and 101 and is returned to the reservoir 78 through the return conduit 82.

When a right turn is initiated, the ram 48 moves to the right in response to a pushing movement of the push-pull cable 47. Such movement of the ram 48 causes the bell crank 111 to pivot around the pivot 112 in the clockwise direction as viewed in FIG. 2 with the result that the spool valve 91 is displaced to the left relative to the valve housing 89. As the spool valve 91 is moved to the left relative to the valve housing 89, the right end land 109 covers or closes off the right end groove 97, the left end land 108 completely uncovers or opens the left end groove 96, and the central land 107 completely uncovers and moves to the left of the central groove 94 thereby isolating the steering port 104 from the inlet port 93. This forms a first passage means, comprising the central groove 94, the cavity 92, the steering port 106 and the first flow passageway 73 in the piston rod 67, which connects the first pressure chamber 61 in fluid communication with the inlet port 93. The first passage means, thus formed, further comprises the return port 98, the left end groove 96, the cavity 92, the steering port 104, the second flow passageway 74 and the piston rod 67, and the apertures 76, which together connect the second pressure chamber 62 in fluid communication with combined return port 101.

As a consequence of the above connections, the piston rod 67 is extended and the valve housing 89 is moved to the right, causing the propulsion unit 11 to be pivoted in a counter-clockwise direction about the steering axis 22 via the steering link 52 and the steering arm 36. As the piston rod 67 extends, the valve housing 89 is moved axially to the right causing the bell crank 111 to undergo a counter-clockwise rotation relative to the pivot 112. Such movement of the bell crank 111 has the effect of displacing the spool valve 91 to the right relative to the valve housing 89. Such movement of the piston rod 67, the bell crank 111, the valve housing 89 and the spool valve 91 continues until the spool valve 91 reaches the no-steering change position, at which time the pressure forces acting on the opposite side of the piston 72 are balanced. Thus, the piston is maintained in a position corresponding to the turn position of the steering wheel 42 until the steering wheel is subsequently rotated to change the direction of boat travel.

When the boat is to be turned to the left, the ram 48 is moved to the left by a pulling movement on the push-pull cable 47: Such movement of the ram causes the bell crank 111 to rotate in the counter-clockwise direction relative to the pivot 112, as viewed in FIG. 2, with the further result that the spool valve 91 is moved from the no-steering change position and is displaced to the right relative to the valve housing 89. When this occurs, the left end land 108 covers the left end groove 96, the right end land 109 completely uncovers the right end groove 97, and the central land 107 uncovers and moves to the right of the central groove 94. This forms a second passage means which comprises the central groove 94, the cavity 92, the steering port 104, the second flow passageway 74 and the apertures 76, and which connects the second pressure chamber 62 in fluid communication with the inlet hydraulic fluid port 93. The second passage means thus formed further comprises the return port 99, the right end groove 97, the cavity 92, the steering port 106, and the first passageway 73 and connects the first pressure chamber 61 in fluid communication with the combined return port 101.

As a consequence of the above connections, the piston rod 67 is retracted and the valve housing 89 is moved to the left, causing the propulsion unit 11 to be rotated in a clockwise direction about the steering axis 22. At the same time, the bell crank 111 undergoes a clockwise rotation relative to the pivot 112 with the result that the spool valve 91 is displaced to the left relative to the valve housing 89. Such movement of the bell crank 111 and the spool valve 91 continues until the spool valve reaches the previously described no-steering change position relative to the valve housing 89.

When the spool valve 91 is in the no-steering change position, a third passage means comprising the central groove 94, the cavity 92, the intermediate groove 103, steering port 106 and the first passageway 73, and also comprising the intermediate groove 102, the steering port 104, the second passageway 74 and the apertures 76, is formed and connects both the first and second pressure chambers 61 and 62 in fluid communication with the hydraulic fluid inlet port 93 to produce substantially equal pressure forces on the opposite sides of the piston 72.

It will be appreciated that the operation of the spool valve assembly 88 and the steering cylinder assembly 51 is such that the piston 72 and the piston rod 67 substantially follows the movement of the steering cable ram 48.

When the push-pull cable 47 is not being moved, extension or retraction of the piston rod 67 causes the valve housing 89 to move relative to the ram 48, and the bell crank 111, in response, causes the spool valve 91 to move in the same direction relative to the valve housing 89. Because of the space occupied by the piston rod 67, the area of the piston side facing the first pressure chamber 61 is larger than the area of the side facing the second chamber 62. Accordingly, when the spool valve 91 is moved to the center or no-steering change position, the piston rod 67 tends to extend and move the valve housing 89 to the right, as viewed in FIG. 2, causing the spool valve 91 to move to the right relative to the valve housing 89, such movement continues until the pressures acting on the opposite sides of the piston 58 are balanced to produce substantially equal forces on both sides of the piston 58. That is, the size of the openings between the right edge of central land 107 and the right edge of the central groove 94 is reduced, thereby reducing the hydraulic pressure supplied to the first pressure chamber 61 via steering port 106, while the size of the opening between the left edge of the central land 107 and the left edge of the central groove 94 is increased, thereby increasing the hydraulic pressure applied to the second pressure chamber 74 via the steering port 104.

External forces, acting upon the propulsion unit 11 and tending to pivot it about the steering axis 22, are resisted in a similar manner. For example, a force tending to pivot the propulsion unit 11 counterclockwise as viewed in FIG. 2 would tend to move the valve housing 89 to the right and increase the opening between the left edges of the central land 107 and the central groove 94 while decreasing the opening between the right edges of the central land 107 and the central groove 94. This would increase the pressure in the second pressure chamber 62 for resisting extension of the piston rod 67.

Various other features and advantages of the invention are set forth in the following claims

I claim:

1. A marine propulsion device comprising a propulsion unit including a propeller adapted to be driven by a power source, mounting means adapted to be mounted on a boat for supporting said propulsion unit for pivotal steering movement around a generally vertical steering axis and including a tilt tube for affording tilting movement of said propulsion unit around a tilt axis substantially transverse to said steering axis, a steering ram within said tilt tube for bi-directional movement relative to said tilt tube and having a projecting end, a power steering cylinder fixed relative to said tilt tube, a piston reciprocable within said power steering cylinder, a piston rod having an inner end connected to said piston and having an outer end extending from said steering cylinder, a spool valve assembly including a first member mounted to said outer end of said piston rod, and a second member reciprocably moveable relative to said first member, an elongate bell crank having a first end pivotally connected to said projecting end of said steering ram, having a second end pivotally connected to said second member and being pivotally connected between said first and second ends to said first member for movement relative to said first member, and linkage means coupled between said outer end of said piston rod and said propulsion unit for pivoting said propulsion unit around said steering axis in response to movement of said piston rod relative to said cylinder.

2. A marine propulsion device in accordance with claim 1 wherein said steering cylinder is substantially parallel to said tilt tube and wherein said reciprocative movement of said second member relative to said first member is in a direction substantially parallel to said tilt tube.

3. A marine propulsion device in accordance with claim 2 wherein said bell crank is oriented substantially perpendicularly to said steering ram such that movement of said steering ram in one direction results in movement of said second member relative to said first member in a direction substantially opposite the direction of movement of said steering ram.

4. A marine propulsion device in accordance with claim 3 wherein said marine propulsion device further comprises a source of pressurized hydraulic fluid and wherein said spool valve assembly, in response to movement of said second member relative to said first member, controls passage of said hydraulic fluid to said steering cylinder to move said piston rod such that said piston rod substantially follows said steering ram in response to movement of said steering ram relative to said tilt tube.

5. A marine propulsion device in accordance with claim 4 wherein said first member comprises a spool valve housing and wherein said second member comprises a spool valve.

6. A marine propulsion device in accordance with claim 1 wherein said propulsion unit includes a steering arm extending substantially radially relative to said steering axis and wherein said linkage means includes a steering link connected between said outer end of said piston rod and said steering arm.

7. A power steering system for a marine propulsion device including a propulsion unit and a mounting assembly for supporting the propulsion unit for pivotal steering movement around a generally vertical steering axis, said power steering system comprising a tilt tube for affording tilting movement of said propulsion unit around a tilt axis substantially transverse to said steering axis, a steering ram within said tilt tube for bi-directional movement relative to said tilt tube and having a projecting end, a power steering cylinder fixed relative to said tilt tube, a piston reciprocable within said power steering cylinder, a piston rod having an inner end connected to said piston and having an outer end extending from said steering cylinder, a spool valve assembly including a first member mounted to said outer end of said piston rod, and a second member reciprocably moveable relative to said first member, an elongate bell crank having a first end pivotally connected to said projecting end of said steering ram, having a second end pivotally connected to said second member and being pivotally connected between said first and second ends to said first member for movement relative to said first member, and linkage means adapted to be coupled between said outer end of said piston rod and the propulsion unit for pivoting the propulsion unit around the steering axis in response to movement of said piston rod relative to said cylinder.

8. A power steering system in accordance with claim 7 wherein said spool valve assembly is oriented such that movement of said steering ram in one direction results in movement of said second member relative to said first member in substantially the opposite direction.

9. A power steering system in accordance with claim 8 wherein said piston moves to drive said piston rod so as to substantially follow movement of said steering ram.

10. A power steering system in accordance with claim 7 wherein said bell crank comprises an elongate member and wherein said pivotal connections to said bell crank are substantially co-linearly aligned.

11. A power steering system in accordance with claim 7 wherein said first member comprises a spool valve housing and wherein said second member comprises a spool valve.

12. A marine propulsion device comprising a propulsion unit including a propeller adapted to be driven by a power source, mounting means adapted to be mounted on a boat for supporting said propulsion unit for pivotal steering movement around a generally vertical steering axis and including a tilt tube for affording tilting movement of said propulsion unit around a tilt axis substantially transverse to said steering axis, a steering ram within said tilt tube for bi-directional movement relative to said tilt tube, a power steering cylinder fixed relative to said tilt tube, a piston reciprocable within said power steering cylinder, a piston rod having an inner end connected to said piston and having an outer end, a spool valve assembly including a first member mounted to said outer end of said piston rod and a second member reciprocably moveable relative to said first member, a link member having a first portion pivotally connected to said steering ram, having a second portion pivotally connected to said second member, and having a third portion pivotally connected to said first member, and linkage means coupled between said outer end of said piston rod and said propulsion unit for pivoting said propulsion unit around said steering axis in response to movement of said piston rod relative to said cylinder.

13. A marine propulsion device in accordance with claim 12 wherein said steering cylinder is substantially parallel to said tilt tube and wherein said reciprocative movement of said second member relative to said first member is in a direction substantially parallel to said tilt tube.

14. A marine propulsion device in accordance with claim 13 wherein said marine propulsion device further comprises a source of pressurized hydraulic fluid and wherein said spool valve assembly, in response to movement of said second member relative to said first member, controls passage of said hydraulic fluid to said steering cylinder to move said piston rod such that said piston rod substantially follows said steering ram in response to movement of said steering ram relative to said tilt tube.

15. A marine propulsion device in accordance with claim 14 wherein said link member is oriented such that movement of said steering ram in one direction results in movement of said second member relative to said first member in a direction substantially opposite the direction of movement of said steering ram.

16. A marine propulsion device in accordance with claim 15 wherein said first member comprises a spool valve housing and wherein said second member comprises a spool valve.

17. A power steering system for a marine propulsion device including a propulsion unit and a mounting assembly for supporting the propulsion unit for pivotal steering movement around a generally vertical steering axis, said power steering system comprising a tilt tube for affording tilting movement of said propulsion unit around a tilt axis substantially transverse to said steering axis, a steering ram within said tilt tube for bi-directional movement relative to said tilt tube, a power steering cylinder fixed relative to said tilt tube, a piston reciprocable within said power steering cylinder, a piston rod having an inner end connected to said piston and having an outer end, a spool valve assembly including a first member mounted to said outer end of said piston rod and a second member reciprocably moveable relative to said first member, a link member having a first portion pivotally connected to said steering ram, having a second portion pivotally connected to said second member, and having a third portion pivotally connected to said first member, and linkage means adapted to be coupled between said outer end of said piston rod and the propulsion unit for pivoting the propulsion unit around the steering axis in response to movement of said piston rod relative to said cylinder.

18. A power steering system in accordance with claim 17 wherein said piston moves to drive said piston rod so as to substantially follow movement of said steering ram.

19. A power steering system in accordance with claim 18 wherein said pivotal connections to said link member are substantially co-linearly aligned.

20. A power steering system in accordance with claim 17 wherein said spool valve assembly is oriented such that movement of said steering ram in one direction results in movement of said second member relative to said first member in substantially the opposite direction.

21. A power steering system in accordance with claim 20 wherein said first member comprises a spool valve housing and wherein said second member comprises a spool valve.

* * * * *